US010455960B2

(12) United States Patent
Young

(10) Patent No.: US 10,455,960 B2
(45) Date of Patent: Oct. 29, 2019

(54) CONTAINER WITH PRESS BUTTON OPENING

(71) Applicant: THINK ONE PTY LTD, South Melbourne (AU)

(72) Inventor: Benjamin James Young, South Melbourne (AU)

(73) Assignee: Think One Pty Ltd, South Melbourne (AU)

( * ) Notice: Subject to any disclaimer, the term of this patent is extended or adjusted under 35 U.S.C. 154(b) by 0 days.

(21) Appl. No.: 15/524,287

(22) PCT Filed: Nov. 6, 2015

(86) PCT No.: PCT/AU2015/000672

§ 371 (c)(1),
(2) Date: May 4, 2017

(87) PCT Pub. No.: WO2016/070234

PCT Pub. Date: May 12, 2016

(65) Prior Publication Data

US 2017/0318993 A1 Nov. 9, 2017

(30) Foreign Application Priority Data

Nov. 7, 2014 (AU) ..... 2014904488

(51) Int. Cl.
*A47G 19/22* (2006.01)
*B65D 47/24* (2006.01)
*B65D 51/16* (2006.01)

(52) U.S. Cl.
CPC ..... *A47G 19/2272* (2013.01); *B65D 47/248* (2013.01); *B65D 51/1683* (2013.01)

(58) Field of Classification Search
CPC ..... A47G 19/2272; A47G 19/2266; A47G 19/2205; B65D 47/249; B65D 47/248; B65D 47/24; B65D 47/20; B65D 47/286; B65D 43/12; B65D 43/20; B65D 51/1683; B65D 51/1672; B65D 51/16; B65D 51/18
USPC ..... 220/714, 715, 713, 711, 254.9, 254.1, 220/259.5, 256.1, 348, 345.4, 345.1, 220/367.1, 827, 830–834; 222/561, 559, 222/547, 544
See application file for complete search history.

(56) References Cited

U.S. PATENT DOCUMENTS 1,525,032 A * 2/1925 Grady ..... B65D 47/248 137/862
3,635,380 A * 1/1972 Fitzgerald ..... A45F 3/16 220/203.17

(Continued)

*Primary Examiner* — Robert J Hicks
(74) *Attorney, Agent, or Firm* — Mark David Torche; Patwrite Law

(57) ABSTRACT

A container lid assembly is provided with a press button opening capability. The lid assembly includes a lid having a first outlet opening and a second air opening. A valve member in the lid has a press button actuator and is moveable between a pushed down open position and a pulled up closed position. A biasing member biases the actuator to an extended closed position and the actuator is pressed against the bias of the biasing member. A lock assembly controls movement of the actuator such that one press of the actuator causes the actuator to adopt one of the open or closed positions and a second press of the actuator causes the actuator to adopt the other of the open or closed positions.

7 Claims, 11 Drawing Sheets

(56) References Cited

U.S. PATENT DOCUMENTS

| | | | | |
|---|---|---|---|---|
| 3,739,938 | A * | 6/1973 | Paz | A47G 19/2272 215/309 |
| 3,972,443 | A | 8/1976 | Albert | |
| 4,750,644 | A | 6/1988 | Kolody | |
| 6,702,138 | B1 * | 3/2004 | Bielecki | A47G 19/2272 220/254.9 |
| 8,272,532 | B2 * | 9/2012 | Michaelian | A47G 19/2272 137/630.14 |
| 8,348,078 | B2 * | 1/2013 | Lane | A47G 19/2272 220/203.04 |
| 2005/0115977 | A1 * | 6/2005 | Dibdin | A47G 19/2272 220/714 |
| 2009/0159595 | A1 * | 6/2009 | Michaelian | A47G 19/2272 220/260 |

* cited by examiner

CONTAINER WITH PRESS BUTTON OPENING

TECHNICAL FIELD

The present invention is directed to a lid for a container and especially for a container that can hold a liquid or flowable solid. The lid is provided with an outlet (drink) opening that can be opened and closed using a press button. The container lid finds particular suitability as a spill proof lid for a beverage container.

BACKGROUND

It is known to provide a drink bottle with a lid that contains an opening that can be opened and closed. For instance, it is known to provide a drink bottle lid with a spout that can be flipped up to the open position and pushed down to the closed position.

It is also known to provide reusable beverage containers such as coffee mugs with a lid that contains a drink opening. The opening can be sealed by a twisting action which causes a small seal to move between a sealing and an open position. A problem with a twist opening is that the seal can deteriorate over time causing spillage.

Another disadvantage with many closures is that the closure mechanism usually forms part of the outlet or is associated closely with the outlet which means that there is or is a possibility of hot liquid spilling onto a person's fingers when trying to close or open the mechanism. Additionally, if the lid assembly is used for somewhat corrosive materials (e.g. bleach) or materials that are otherwise unpleasant to the touch, there is always the possibility that the material will be spilt onto the person's fingers during opening or closing of the mechanism.

Various other attempts have been made to provide a container lid having an outlet opening and which can be reliably sealed repeatedly and without early deterioration of the seal. However, these have suffered from disadvantages including the complexity of manufacture, the relatively large number of small parts required, difficulty in pressure equalization as liquid is removed from the container through the outlet and complexity surrounding the means to open and close the outlet opening.

It is an object of the invention to provide a lid assembly with a push button opening and closing arrangement and which may overcome at least some of the above-mentioned disadvantages or provide the public with a useful or commercial choice.

Any references to methods, apparatus or documents of the prior art are not to be taken as constituting any evidence or admission that they formed, or form part of the common general knowledge.

SUMMARY OF THE INVENTION

According to a first aspect of the present invention there is provided a container lid assembly with a press button opening, the lid assembly comprising:

a lid adapted for connection to a container, the lid having a first outlet opening and a second air opening, a valve member in the lid, a press button actuator, a biasing member, and a lock means wherein:

the valve member is moveable between a pushed down open position where the outlet opening and the air opening are open and a pulled up closed position where the outlet opening and air opening are closed by the valve member, the press button actuator is connected to the valve member and is moveable between a depressed open position where the actuator moves the valve member to its open position and an extended closed position where the actuator moves the valve member to its closed position, the biasing member biases the actuator to the extended closed position and the actuator is pressed against the bias of the biasing means, the lock means controlling movement of the actuator such that one press of the actuator causes the actuator to adopt one of the open or closed positions and a second press of the actuator causes the actuator to adopt the other of the open or closed positions.

Thus, the arrangement allows the contents of a container to be accessed by a simple single press of the actuator and the container can be securely sealed by a second press of the actuator.

The lid assembly will find particular suitability with beverage containers and especially with beverage containers containing a hot liquid such as hot coffee or hot tea. The beverage can be sipped by a simple press of the actuator and the container can then be sealed against spillage and spillage by a second simple press of the actuator. The lid assembly, when attached to a beverage container, can enable the beverage to be consumed while driving a car, walking et cetera.

The lid assembly may also be suitable for use with containers containing other types of liquids. These liquids may include soup and other consumable liquids. The lid assembly may also be suitable for use with containers containing flowable consumable solids. These may include spices, herbs, salt, and the like, with the advantage that the lid assembly can tightly seal the container against ingress of air, ants and the like and can control the flow of material from the container.

The lid assembly may be suitable for use with containers containing non-consumable liquids or flowable solids where there is an advantage in providing a sealing arrangement subject to the present invention. These liquids or flowable solids may comprise air sensitive materials, odorous materials were a tight seal is required, or liquids and flowable solids where there is an advantage in using a relatively small opening in the lid to control the flow of liquid/solid.

The lid assembly may be insulated and may be adapted for connection to an insulated container which may be suitable to maintain a hot or cold beverage at a desired temperature for as long as possible.

The container may comprise any suitable shape and size and may be made of any suitable material. It is envisaged that the container will be made of plastic but it is not considered that any unnecessary limitation should be placed on the invention merely by the exemplification of a particular suitable material or a particular shape or size of the container.

The container lid may comprise any suitable shape and size and may be made of any suitable material. It is envisaged that the lid will be made of plastic but it is not considered that any unnecessary limitation should be placed on the invention merely by the exemplification of a particular suitable material or a particular shape or size of the lid.

The lid may comprise a top wall and a side wall. It is envisaged that the lid will be substantially cylindrical in configuration and will therefore have a substantially circular and relatively planar top wall and a depending surrounding sidewall. It is envisaged that the lid will be made of a unitary material (typically plastic), however there may be circumstances where there is an advantage in manufacturing the lid in separate components that can be attached together by any suitable means such as adhesive, plastic welding and the like.

The top wall of the lid will suitably be provided with the outlet opening and the air opening. Suitably, these openings will be spaced from each other and it is particularly preferred that the openings are diametrically opposed. This can minimise hot beverage passing through the air opening when the beverage container is tipped for drinking.

The outlet opening can have various sizes and configurations depending on use. If the lid assembly will be used with a beverage container, the outlet opening will have a size and configuration suitable for sipping or drinking. As a non-limiting example, in a beverage container, the outlet opening may be substantially circular and may have a diameter of between 5-15 mm and typically between 7-10 mm.

The air opening may also have any suitable shape and size. For use with a beverage container it is advantageous for the air opening to be as small as possible to minimise inadvertent passage of the contents of the container through the air hole or for insects to pass through the air hole, and in a nonlimiting example, the air hole may have a diameter of between 1-4 mm and typically between 1-2 mm. Although it is considered suitable for a single air hole to be provided for use with a beverage container, there may be circumstances where there is an advantage in providing more than one air hole or in configuring the air hole to be other than circular.

The lid will suitably be provided with a passageway extending inwardly from the top wall of the lid. The passageway will typically comprise a side wall and an inner end wall. The inner end wall may be provided with an opening to enable the actuator to be connected to the valve member and this will be described in greater detail below. The inner end wall may also be provided with an array of guide portions to assist with the opening and closing of the valve member and this will be described in greater detail below.

The lid may be attached to the container by any suitable means. One suitable means may comprise threading engagement of the lid to the container and in this example, a lower end of the lid may be provided with internal or external threads that can threadingly engage with threads on an upper part of the container. However, the lid may also be attached by other means including a press seal arrangement, a twist lock arrangement, the use of press lock lugs and the like.

The container lid assembly further includes a valve member. The valve member is typically located within the confines of the lid and does not project from any part of the lid.

The valve member may comprise a central body portion and at least one sealing portion, the sealing portion adapted to seal against the outlet opening and the air opening in the lid. The central body portion may be configured to extend about an external part of the lower end of the passageway that may form part of the lid. Suitably, the central body portion is configured to be slidable along a lower end of the passageway.

The central body portion suitably contains an opening to assist in attaching the member to the actuator and this will be described in greater detail below The sealing portion may comprise a first portion adapted to seal against the outlet opening in the lid and a second portion adapted for sealing against the air opening in the lid. The first portion and the second portion may comprise short leg members. Each leg member may contain a seal member. The seal members may be formed separately and attached to the leg member, for instance, to enable the seal member to be easily replaced if required, or to enable the seal member to be formed from a separate sealing material. Alternatively, the sealing portion may comprise an annular part extending about the central body portion and containing seals positioned to align with the outlet opening and the air opening.

The assembly includes an actuator which will typically be a press button or pushbutton actuator. The actuator may comprise a relatively flat head portion adapted to be pressed, and a depending pin portion. The head portion is suitably configured to substantially fill the upper end of the passageway in the lid to provide an aesthetically pleasing appearance and to minimise any passage of debris or grime between the head portion and the passageway.

The pin portion is suitably substantially rigid and suitably of sufficient length to enable it to attach to the valve by any suitable means. One suitable means will include a lock nut or something similar that can be attached to the end of the pin to attach the actuator to the valve. However, it is envisaged that other means of connecting the actuator to the valve may also be used including some form of direct connection of the pin portion (or other parts of the actuator) to the valve (for instance by some form of press lock arrangement). It is also envisaged that the pin portion may be threaded directly into engagement with a threaded recess in the valve portion as opposed to the use of a separate nut.

The assembly includes a biasing means. The biasing means may comprise a spring. The spring may comprise a helical spring. The helical spring may be located in the passageway on the lid. The helical spring may have one end towards the inner end wall of the passageway and the other end against the underside of the actuator. In this manner, the biasing means may function to push the actuator to an extended closed position.

The lid assembly includes a lock means. The lock means functions to control movement of the actuator such that one press of the actuator causes the actuator to adopt one of the open or closed positions and a second press of the actuator causes the actuator to adopt the other of the open or closed positions.

The lock means may comprise a first member and a second member that can cooperate with each other to provide the desired locking arrangement. The first member may comprise an inner member and the second member may comprise an outer member. The inner member will typically be able to locate within the outer member. The lock means will typically be located within the passageway of the lid.

The first (inner) member may also be known as an "activation ring", and the second (outer) member may also be known as a "height ring".

The first member may include at least one fin, and the second member may include at least one slot whereby the inner member is able to slide freely relative to the outer member when the fin and slot are aligned and the inner member is locked to the outer member when the fin and slot are not aligned.

Suitably, the second member is additionally provided with a profile to hold the two members together when not aligned.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
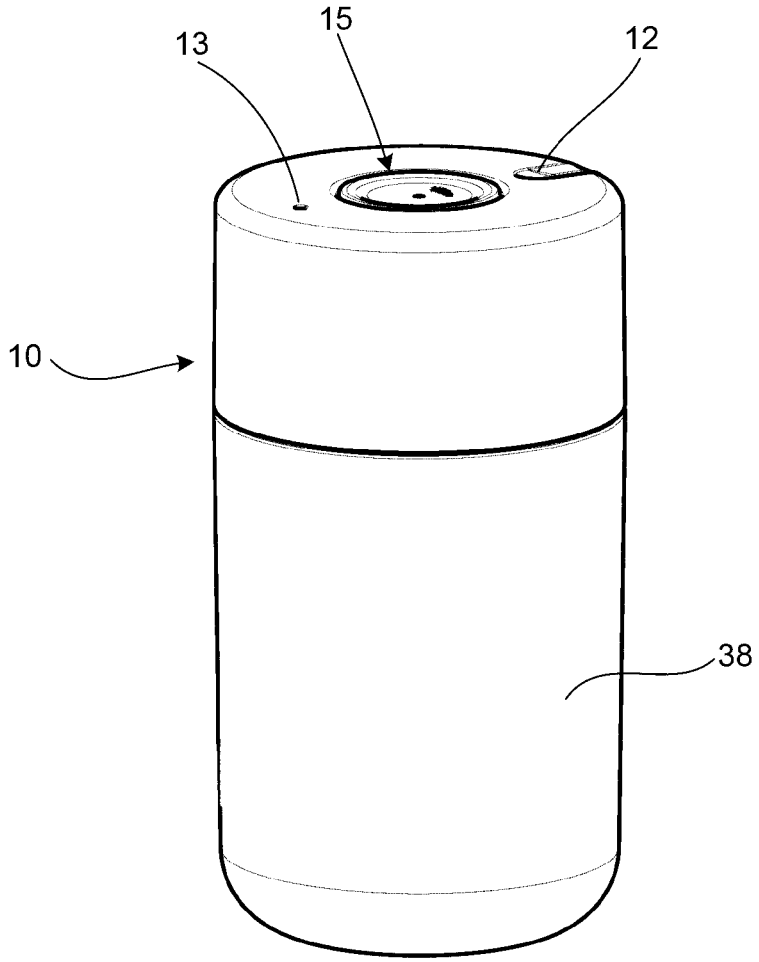
FIG. 1. Illustrates a beverage container containing the lid assembly according to an embodiment of the invention.
Figure 3:
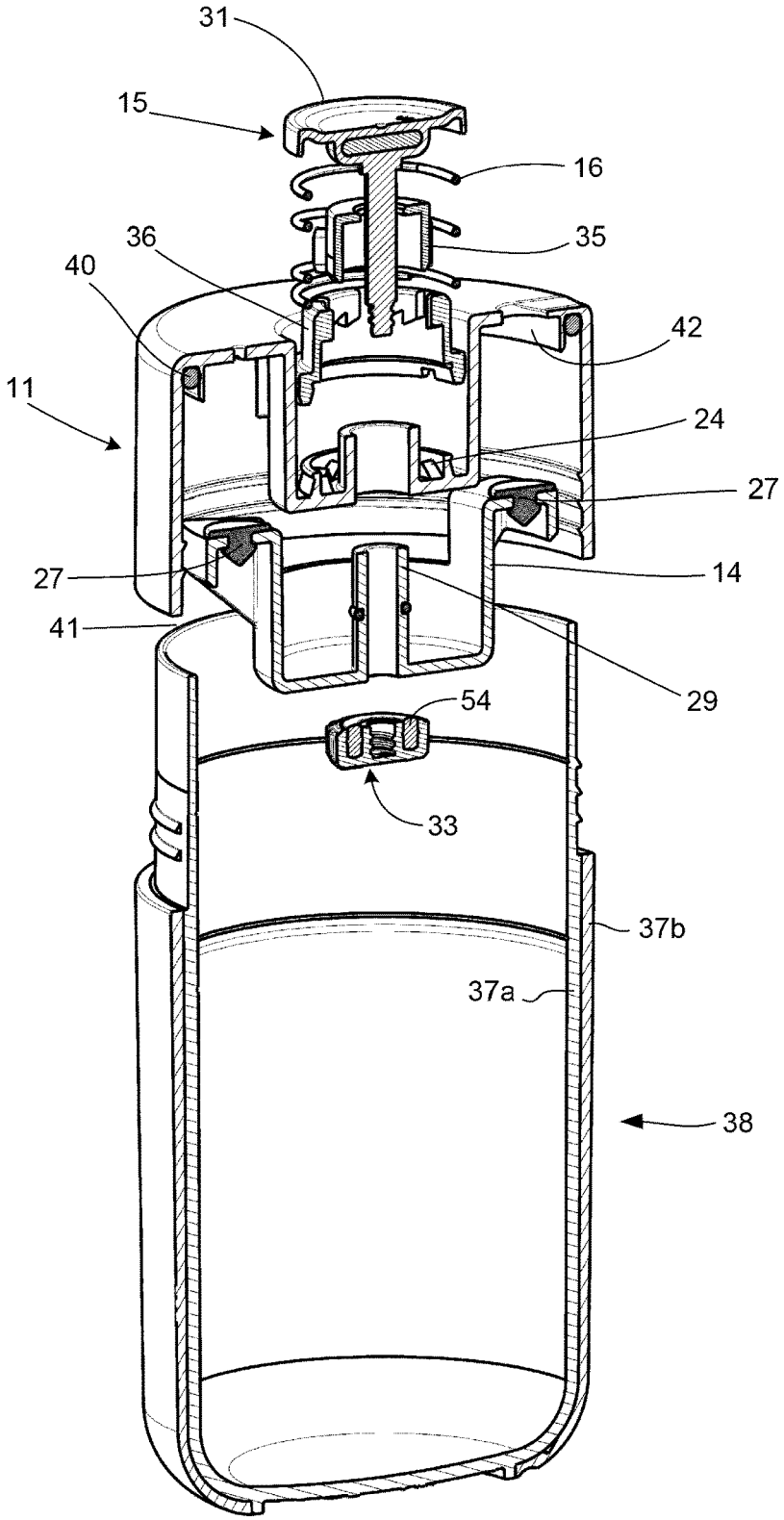
FIG. 3. Illustrates a partially cutaway view of the lid assembly.
Figure 6:
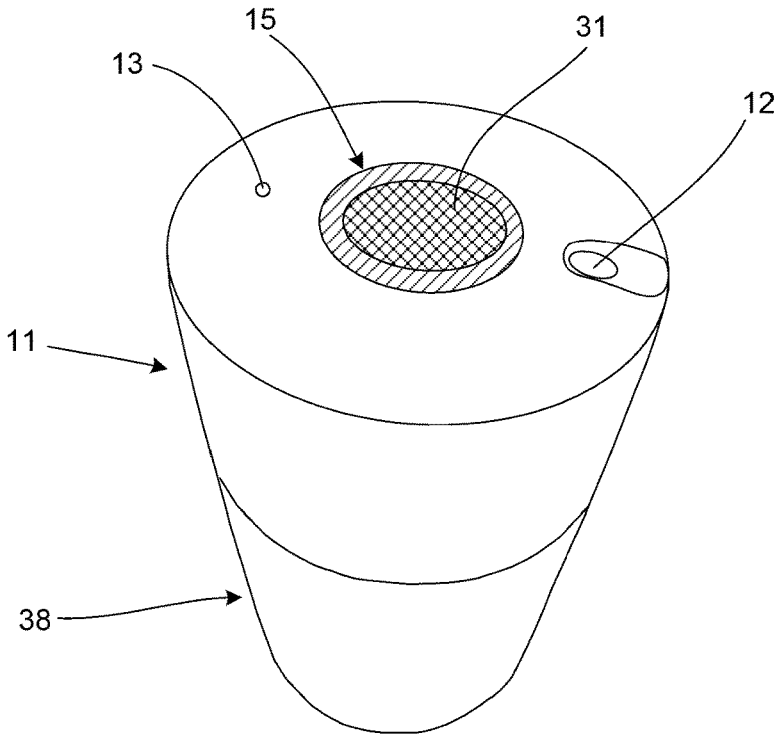
FIG. 6. Illustrates the lid assembly attached to a container and in the closed position.
Figure 7:
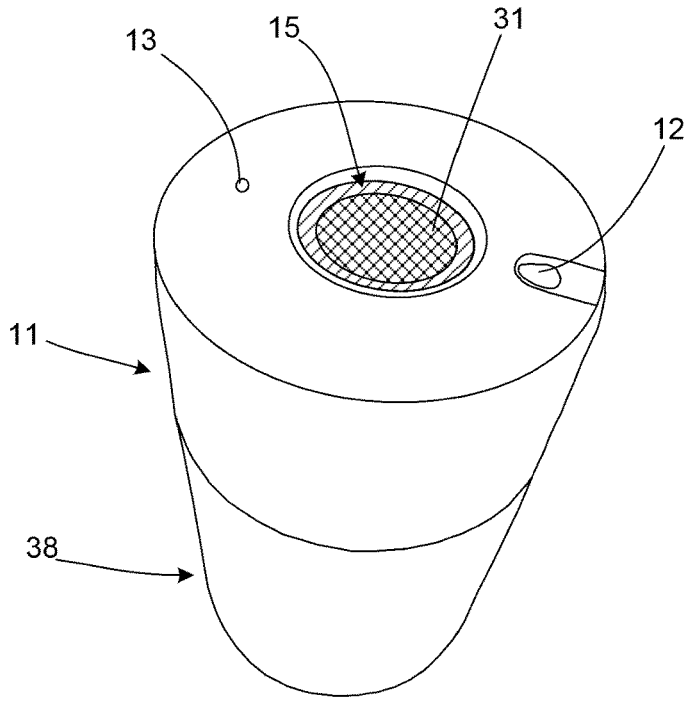
FIG. 7. Illustrates the lid assembly of FIG. 6 in the open position.

Referring initially to FIG. 1, FIG. 6 and FIG. 7 there is illustrated an assembly comprising a lower beverage container 38 which, in the particular embodiment, comprises a coffee mug, and an upper lid assembly 10 which forms part of the present invention. In the embodiment shown in FIG. 3 the beverage container 38 includes an inner portion 37*a* that is preferably of food grade plastic that is surrounded by an insulating jacket 37*b*, which in the present embodiment is a suitable thermoplastic elastomer (TPE). It will be realised that where the beverage container may be used as a water bottle for example in which case the insulating jacket 37*b* may be omitted. Furthermore, the dimensions of the beverage container may be varied, for example it may be made taller, to increase the volume of beverage that it is able to store. The lid assembly 10 is threadingly engaged to the container 38. The lid assembly 10 comprises a press button actuator 15 which can be moved between an upper closed position (FIG. 6) where the outlet opening 12 is sealed, and a slightly pushed down open position (FIG. 7) where outlet opening 12 is open and the contents of the container can be sipped.

Figure 8:
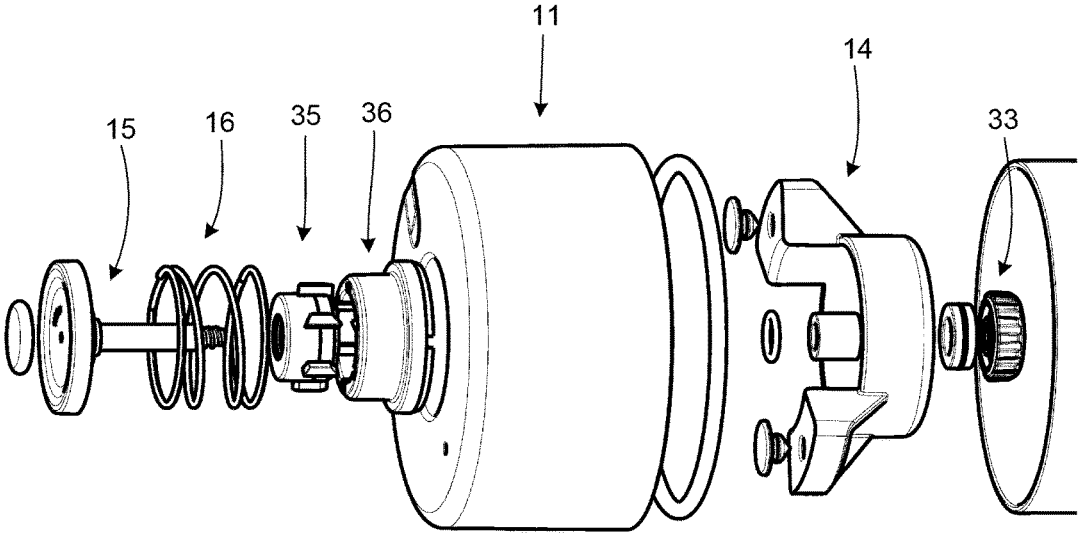
FIG. 8. Illustrates the various components of the lid assembly.

FIG. 8 illustrates the various major components of the lid assembly. These components comprise a hollow open bottomed lid 11, a valve member 14, a press button actuator 15, a biasing member 16, a lock nut 33 which attaches to actuator 15 in a manner which will be described in greater detail below, and a lock means which comprises a first (inner) member 35 (which can also be called an activation ring) and a second (outer) member 36 (which can also be called a height ring).

Reference will now be made in greater detail to each of the parts and components of the assembly.

Figure 9:
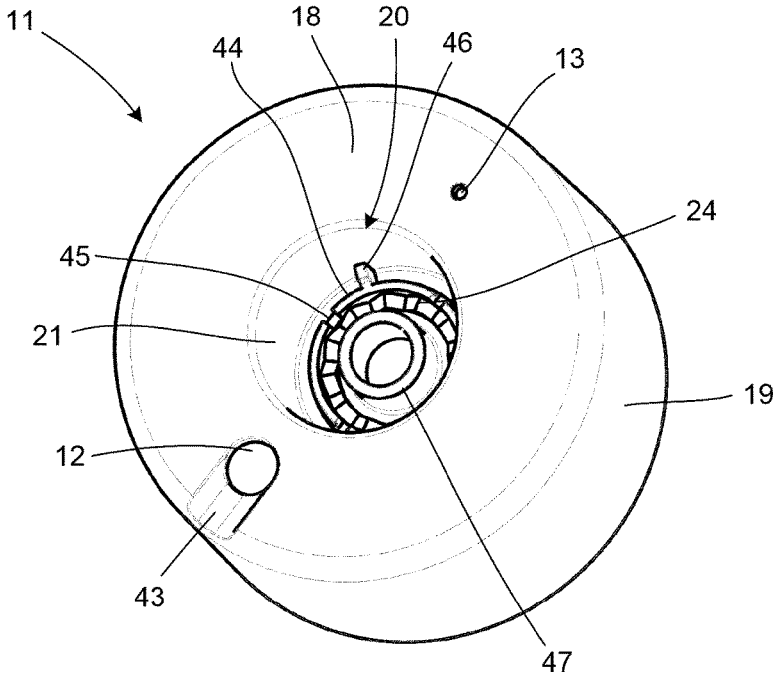
FIG. 9. Illustrates a top view of the lid particularly illustrating the outlet opening, the air opening and the passageway.
Figure 10:
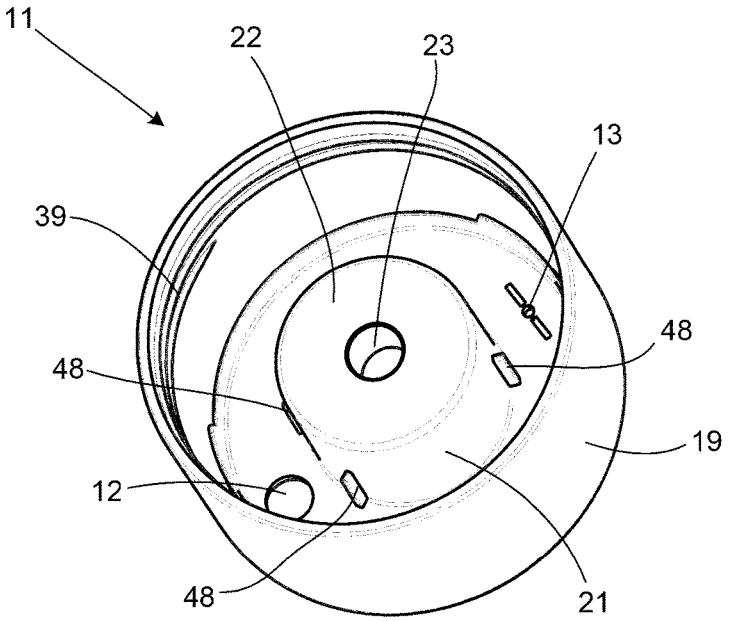
FIG. 10. Illustrates a bottom view of the lid.

Referring at least to FIG. 9 and FIG. 10, there is illustrated a front view and a rear view respectively of lid 11. Lid 11 is made of plastic and comprises a top wall 18 and a side wall 19. The lid is made in one piece. In a nonlimiting embodiment, the top wall is circular and has a diameter of about 70 mm and the side wall has a height of about 40 mm. This can of course vary depending on the shape and size of the container to which the lid is attached.

The lid is open at the bottom and the lower peripheral edge area of the side wall contains an internal thread 39 (best illustrated in FIG. 10) to enable the lid to be threadingly engaged to a lower container. To provide a good spill proof seal, a sealing ring 40 (see FIGS. 2 and 3) is positioned in a small formed channel 42 such that when the lid is screwed down onto the container, the sealing ring 40 will be sandwiched between the rim 41 of the container and the channel 42 in the lid.

Referring again to FIG. 9, the top wall 18 of the lid is formed with a larger outlet (drink) opening 12 and a smaller air opening 13. These openings are diametrically opposed to each other. The air opening is a circular hole extending through the top wall 18 and has a diameter of about 1-2 mm. The outlet opening 12 is where the contents of the container pass through and is a circular opening passing through the top wall 18 and having a diameter of approximately 8-10 mm. A shallow channel 43 is formed into top wall 18 but does not pass through the top wall and functions as a guide for the beverage.

In the centre of the top wall 18 is a passageway 20 which extends into the otherwise hollow interior of the lid and which terminates inwardly from the lower end of the side wall such that passageway 20 does not project from the lower end of the lid. Passageway 20 is formed integrally with the lid and comprises a circular internal side wall 21 (see FIG. 9) which terminates in an inner end wall 22 (see particularly FIG. 10). Inner end wall 22 is provided with a central opening 23 in to allow part of actuator 15 to pass there through and this will be described in greater detail below. Central opening 23 is defined by a small raised spigot, this cooperating with part of the valve member 14 which will be described in greater detail below.

FIG. 9 illustrates that the inner end wall 22 facing into passageway 20 has a particular profile and the profile comprises an annular sets of guide portions 24 which comprise spaced upwardly extending triangular teeth. Surrounding the triangular teeth is an annular rib 44 which is provided with four equally spaced apart cutouts 45. Finally, the inner end wall 22 comprises two small locking fins 46 (only one illustrated in FIG. 9) which functions to lock the second outer member (height ring) 36 against rotation and this will be described in greater detail below.

Referring to FIG. 10, the inside side wall 21 of the passageway contains a pair of spaced apart lugs 48 (only one full pair illustrated in FIG. 10) and which function to hold the valve member in a particular orientation and this will be described in greater detail below.

Referring now at least to FIGS. 11 A-C there is illustrated various views of the valve member 14. It can be seen that valve member 14 is more than just merely a sealing member and contains a particular profile. Valve member 14 is a unitary member made of plastic although it should be appreciated that this is according to a nonlimiting embodiment of the invention only. The valve member has a central body portion 25 and a pair of oppositely extending leg members or "ears" 28. The central body portion 25 comprises a base wall 49 and a side wall 50. The internal diameter of the central body portion is such that it can fit over the external side wall 21 (see FIG. 10) of the passageway in the lid 11. Also, the central body portion can slide up and down (reciprocate) along the external side wall. This sliding up and down movement forms part of the opening and sealing of the outlet opening 12 and air opening 13 in the lid. The leg members 28 are sized to fit between a respective pair of the lugs 48 on the lid 11 which means that the valve can slide up and down along the internal side wall but the valve cannot turn clockwise or anticlockwise on the side wall as this movement is prevented by the lugs 48 extending along each side of each leg member 28.

The valve member 14 is provided with an upstanding spigot like opening 29. The diameter of the spigot 29 is such that it can pass through opening 23 in lid 11 (see FIG. 10) with a close tolerance. A small but important O ring seal 51 (see FIGS. 11A and 11C) is provided on the outside of spigot 29. The seal 51 is a low coefficient (low friction) silicone material and assists in the products ease of use with regards to the amount of pressure it takes the user to operate the spring loaded mechanism (that is, to open and seal the outlet opening 12 and air opening 13 in the lid). Seal 51 frictionally engages with the inside wall of the opening 23 and provides the friction sliding movement between the valve member 14 and the lid.

Finally, the spigot like opening 29 has an internal passageway to accommodate part of actuator 15 which will be described in greater detail below.

Figure 11A:
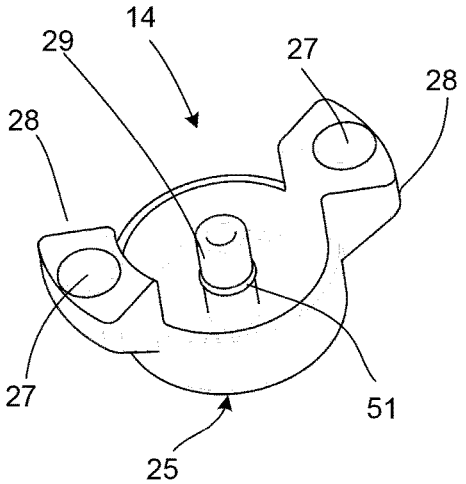
FIGS. 11A-C. Illustrate the valve member.
Figure 11B:
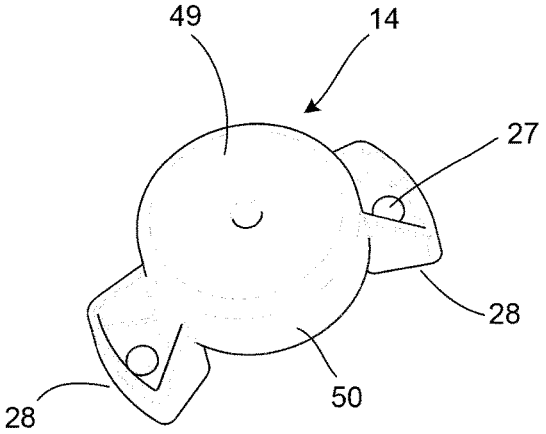
Figure 11C:
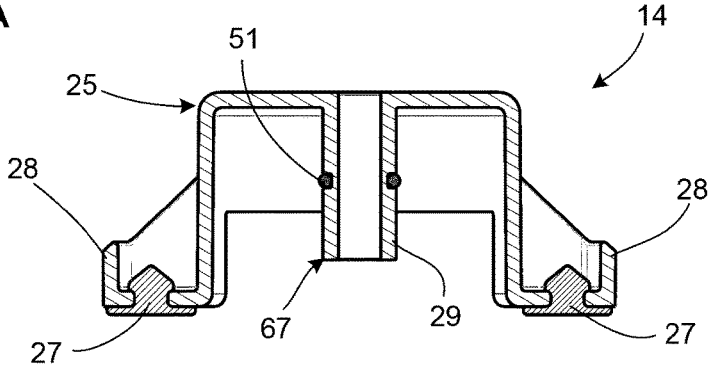
Figure 11D:
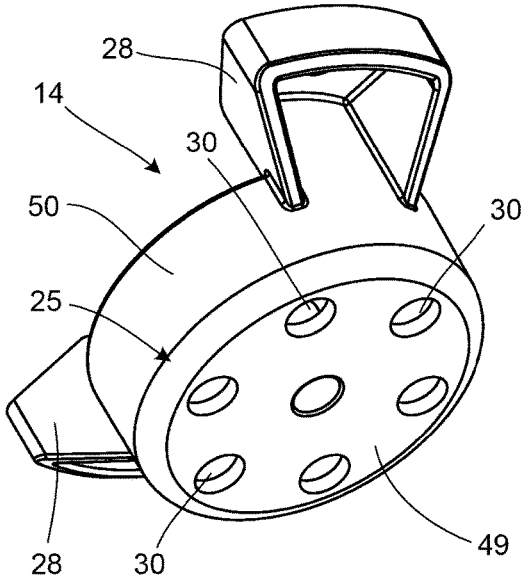
FIGS. 11D-G. Comprise isometric, top and side views of a preferred variation of the valve member wherein it is formed with cleaning apertures therethrough.
Figure 11E:
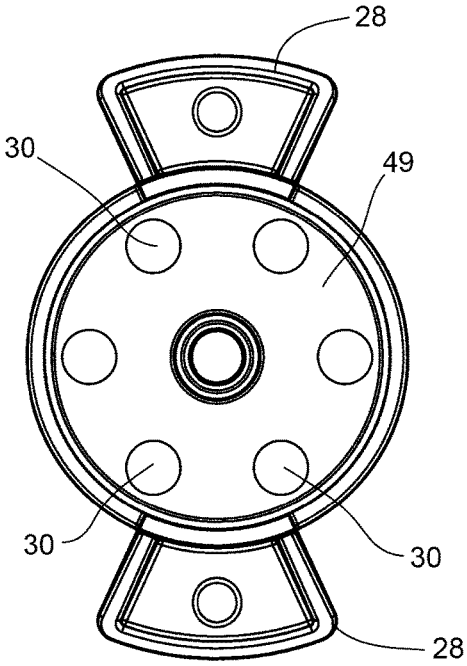
Figure 11G:
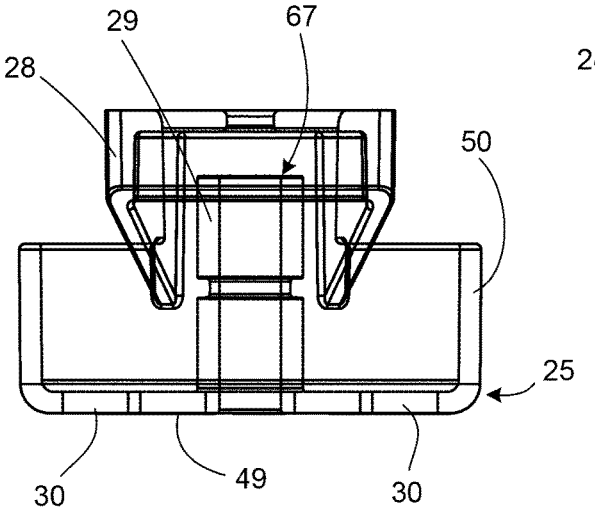
Figure 11F:
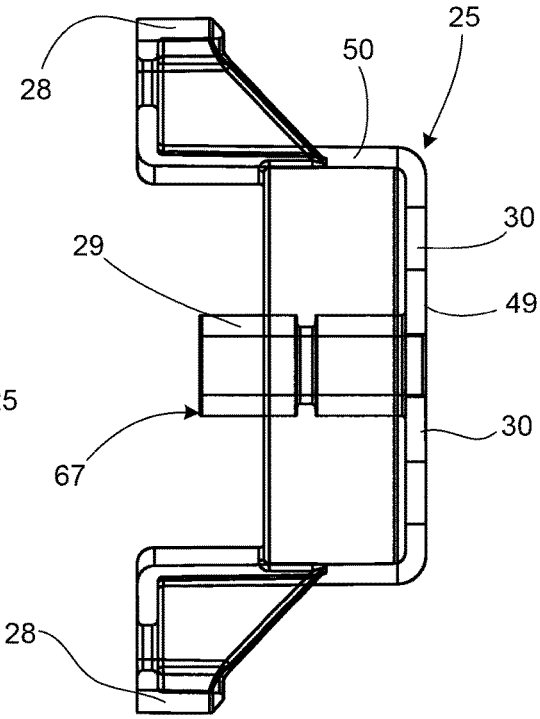

Each leg member 28 of valve member 14 is provided with a sealing member 27 which comprises a separate part which can be press fitted into an opening in each leg member 28 this being best illustrated in FIG. 11C. This enables the valve member 14 to be made of harder less resilient (and longer wearing) material while allowing the sealing members 27 (formed separately) to be made of a softer better sealing material.

Referring now to FIGS. 11D to 11G the valve member 14 may be modified by including a number of apertures 30 disposed about the base wall 49 for example in a circular pattern. Apertures 30 are included to facilitate cleaning of the inside of the valve member 14 by allowing water to pass into and out of it.

Figure 12A:
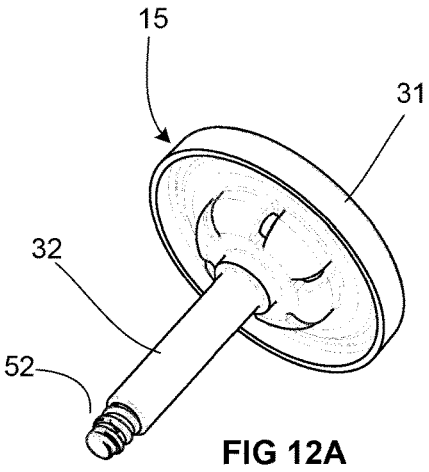
FIG. 12A-B. Illustrates the actuator.
Figure 12B:
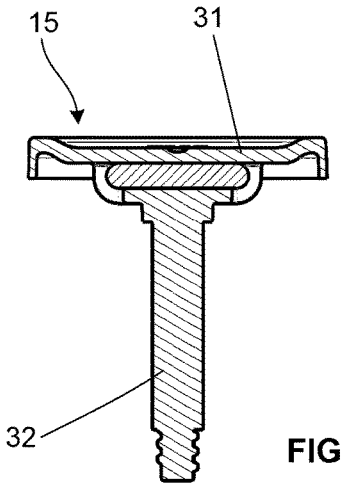

Referring at least to FIG. 8, and FIGS. 12A-12B, there is illustrated the actuator 15 which forms part of the press button opening. Actuator 15 is formed of a unitary plastic material and comprises a large easily visible and operable circular head portion 31 and a depending tail or pin portion 32. The head portion 31 comprises the "button" which is pushed down by a user of the lid assembly. As illustrated at least in FIG. 6 and FIG. 7, the actuator 15 sits within the lid and the head portion 31 and most of the pin portion 32 sits within the passageway 20. Additionally, the shape of the head portion 31 is such that an almost completely fills the passageway such that there is little chance of grime or debris passing into the passageway and past the head portion.

Figure 2:
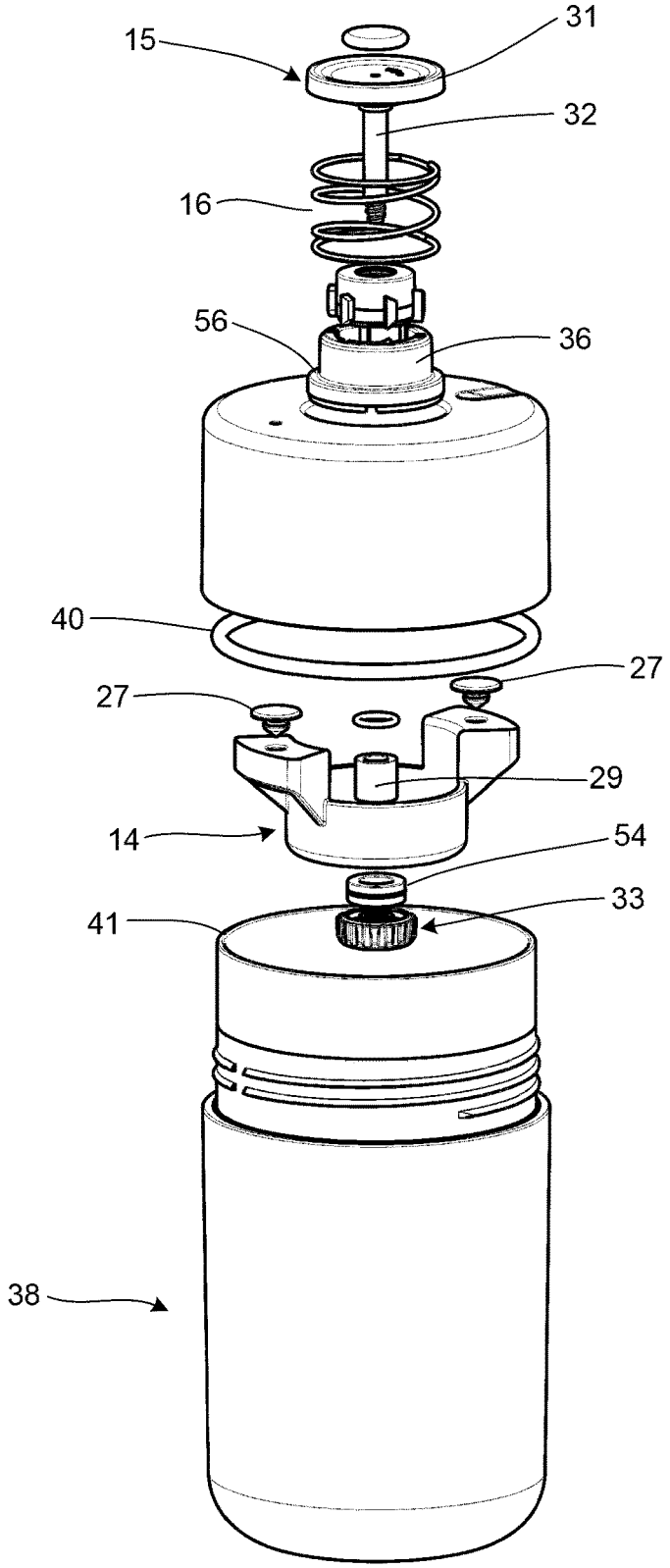
FIG. 2. Illustrates an exploded view of the lid assembly.
Figure 17A:
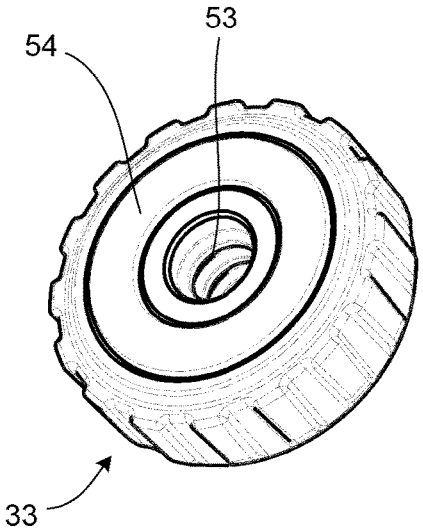
FIGS. 17 A-B. Illustrate a lock nut.
Figure 17B:
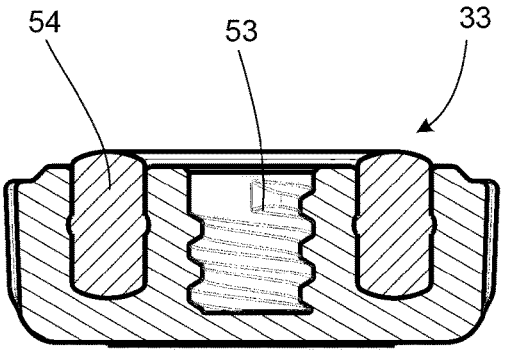

The pin portion 32 terminates in a thread 52 (see at least FIG. 12A), and this threadingly engages to a lock nut 33 which is illustrated at least in FIGS. 17 A-B, and also in FIG. 8. Lock nut 33 comprises an internal thread 53 and a surrounding O ring 54 which extends slightly proud of the internal face of the lock nut. In use, the pin portion 32 of the actuator 15 passes through the internal passageway of spigot 29 of the valve member 14 and the lock nut 33 is screwed onto the threaded end portion of pin portion 32 and clamps against the outside of base wall 49 of the valve member 14 in a sealing type manner by virtue of the O ring 54. The arrangement in an exploded view is illustrated in FIG. 2 which illustrates the pin portion 32 of the actuator able to pass through the spigot type opening 29 of valve member 14 and connect to the lock nut 33. The assembled (section) view is illustrated at least in FIG. 4 and FIG. 5.

Thus, it can be seen that pushing down (opening) actuator 15 (by depressing the button like head portion 31—see FIG. 7) causes the valve member 14 to be pushed downwardly and returning the actuator 15 to its extended (closed) position (see FIG. 6) causes the valve member 14 to be pulled upwardly.

The valve member 14 is specifically positioned on the external side wall of passageway 20 such that one of the sealing members 27 on valve member 14 is positioned directly below the outlet (drink) opening 12 in the lid, and the other sealing member 27 is positioned directly below the air opening 13 in the lid. This arrangement is illustrated at least in FIG. 4 (closed position) and FIG. 5 (open position). Thus, when the valve member 14 is pulled upwardly it assumes the position of FIG. 4 where the sealing members 27 seal the outlet opening 12 and the air opening 13. Conversely, when valve member 14 is pushed downwardly, it assumes the position of FIG. 5 where it can be seen that the sealing members 27 are spaced from the respective openings 12, 13 which now allows beverage to pass from the container and through drink opening 12 and allows air to pass into the container through air opening 13 to pressure equalise the container.

One advantage of this arrangement is that the sealing is achieved by a linear "push/pull" action as opposed to a twisting action or other type of action that causes a shear force to be applied to the seal which can cause enhanced wear and tear and therefore the potential for spillage. In the present embodiment, the sealing action is by a reciprocating push/pull action which causes very little wear and tear on the seals 27.

A biasing member in the form of a helical spring 16 forms part of the lid assembly. The spring 16 is positioned in the passageway 20 of lid 11 and this is illustrated at least in FIG. 4, FIG. 5, and partially illustrated in FIG. 2. Spring 16 extends about pin portion 32 of actuator 15 and has one (upper or outer) end trapped underneath the head portion of the actuator and has the other (lower or inner) end extending about and trapped by a small flange 56 on the second outer member 36 (see at least FIG. 13 A) and this will be described in greater detail below.

Thus, the function of spring 16 is to push the actuator 15 upwardly/outwardly into the extended (closed) position illustrated in FIG. 6. Full extension of the actuator away from the lid is prevented as the actuator is connected to the valve member 14 via lock nut 33. Thus, actuator 15 is spring-loaded and is pressed into passageway 20 on the lid 11 against the force of the spring.

Another part of the present invention is the lock means that locks the actuator 15 into the depressed (open) position illustrated in FIG. 7 when the actuator is pressed once and which releases the actuator to be pushed back (by spring 16) into the extended (closed) position illustrated in FIG. 6 when the actuator is pressed again.

In the present embodiment, the lock means is provided at least partially by a pair of cooperating members comprising a first inner ring like member 35 and a second larger outer ring like member 36. Inner member 35 is also known as an "activation ring" and outer member 36 is also known as a "height ring". The inner member 35 is best illustrated at least in FIGS. 14 A-B and outer member 36 is best illustrated at least in FIGS. 13 A-B.

Figure 13A:
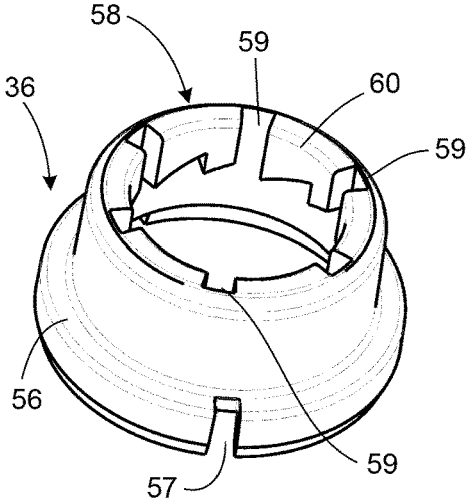
FIG. 13A-B. Illustrate the second (outer) member (also known as height ring) comprising the other parts of the lock means.
Figure 13B:
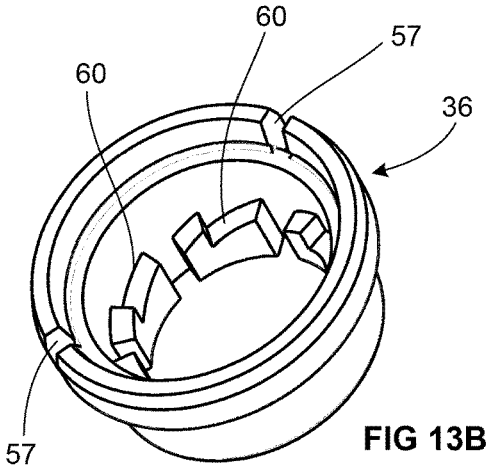

Referring initially to the outer member 36, this member locates entirely within passageway 20. As described above (and illustrated at least in FIG. 9), the inner end wall 22 of the passageway contains a pair of locking fins 46. Locking member 36 is provided with a pair of peripheral cutout portions 57 and these locate about locking fins 46 when outer member 36 is positioned within the passageway. This locks the outer member 36 against the locking fins 46 and prevents the outer member from rotating. This is important as the other profiles of the outer member need to be correctly aligned with profiles on the inner member. Referring to FIGS. 13 A 13 B, locking member 36 contains a small outwardly extending flange 56 which has been described previously and functions to abut against the lower (inner) end of spring 16.

Outer member 36 contains an upper (outer) end 58. This outer end is formed with a particular profile which comprises a first series of equally spaced apart slots 59 and a second series of ramped but somewhat L-shaped holding or blocking profiles 60 which extend between slots 59 and on the inside of the upper end of outer member 36.

Figure 14A:
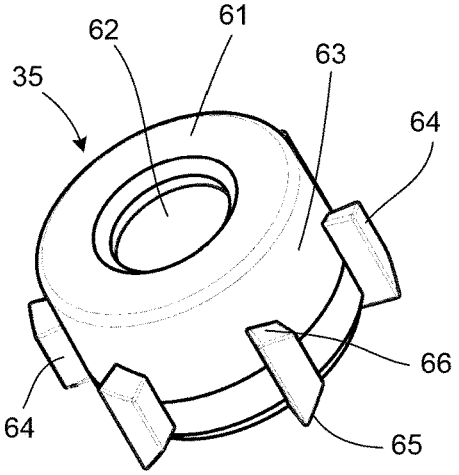
FIG. 14A-B. Illustrate the first (inner) member (also known as activation ring) comprising part of the lock means.
Figure 14B:
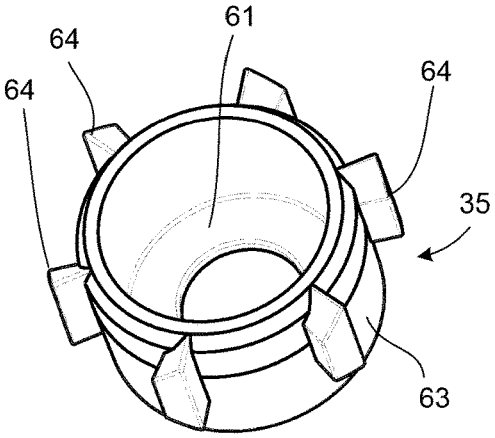

Referring now to the first inner member 35 and with reference to FIGS. 14 A and 14 B, the inner member comprises a substantially hollow cylindrical body having a top wall 61 formed with a central opening 62, and having a side wall 63 containing equally spaced apart outwardly extending fins 64. The fins extend from a bottom of the side wall 63 to approximately ⅔ of the way along the side wall. Each fin has an angled or ramped bottom wall 65 and an angled or ramped top wall 66.

Figure 15:
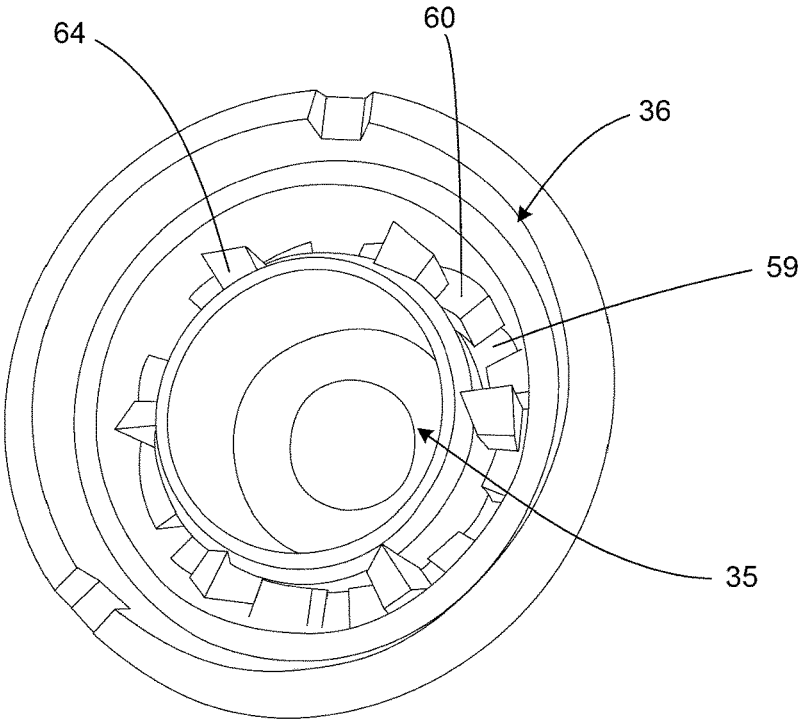
FIG. 15. Illustrates the first member located within the second member and in the locked position.
Figure 16:
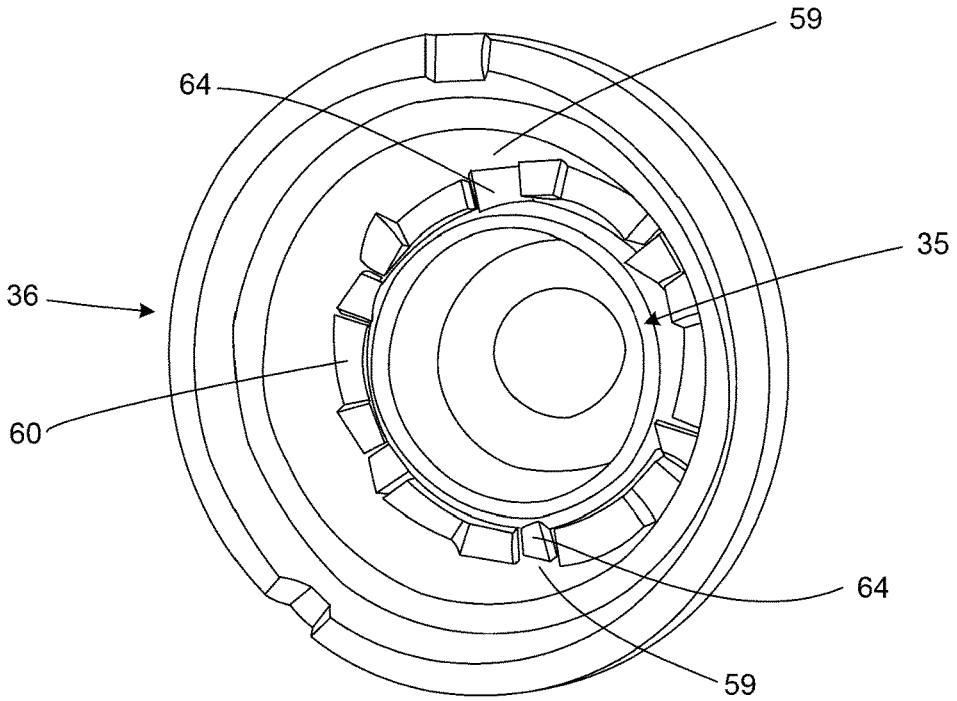
FIG. 16. Illustrates the first member located within the second member and having been rotated to the free position.

The inner ring shaped member 35 is sized to sit within the second outer member 36. This arrangement is illustrated at least in FIG. 15 and FIG. 16. The arrangement is such that when the fins 64 on the outside of inner member 35 aligned with the slots 59 in the outer member 36, the inner member can slide past the outer member. This arrangement is illustrated in FIG. 16. However, when the inner member is slightly rotated relative to the outer member such that fins 64 do not align with slots 59, the inner member is trapped (locked) and cannot move through the outer member. When in the trapped position (FIG. 15), the fins engage against the profiles 60 on the inside of second outer member 36. Because of the L-shaped profile 60, the inner member cannot rotate in one direction relative to the outer member as the fins 64 will abut against the L-shaped profile, but the inner member can rotate in the opposite direction which will cause the fins 64 to ride along the ramped part of the profile 60 until the fins reach a respective slot 59 at which stage the inner member is free to slide relative to the outer member.

The operation of the lock means will now be described. Importantly, the spigot portion 29 (see for instance FIG. 11 A) of valve member 14 is quite long and extends past the confines of the central body portion 25. Put differently, and as illustrated in FIG. 11 C, the end portion 67 of spigot 29 extends above the side wall 50 of valve member 14. Thus, when valve member 14 is fitted about the outer wall of passageway 20 (see for instance FIG. 4 or FIG. 5) the spigot 29 extends through and past the short spigot 47 (see also FIG. 9) in the passageway 20 of the lid 11.

The outer diameter of spigot 29 is larger than the opening 62 (see 14 A) in the first inner member 35. Thus, when the valve member 14 is pulled upwardly into the sealing position (see the section view of FIG. 4), the spigot 29 abuts against the underside of top wall 61 of the first member 35 and pushes the first member 35 along the inside of second member 36. The second member 36 cannot move as it is prevented against rotation by being locked into the locking fins 46 and is further prevented against sliding movement by being pushed down by spring 16.

If the first member 35 is in a first rotational position relative to the second member 36 such that the fins 64 on the first member 35 align with the slots 59 on the (immovable) second member 36, first member 35 can slide at least partially through and past the second member. When this occurs, the top of the first member pushes against the underside of the actuator 15 and specifically against the underside of the head portion 31 of the actuator 15, and causes the actuator to be pushed up (also by the spring) into the extended closed position.

When the actuator is pressed downwardly, the underside of the actuator will push down the first member 35 back into the confines of the second member 36. At some stage, the angled bottom wall 65 of each of the fins 64 will engage against the guide portions 24 (see FIG. 9) located at the bottom of passageway 20 in the lid. When this happens, the ramping engagement will cause the first member to be rotated in one direction by a small amount which is determined by the length of the ramped walls 65 and the size of the guide portions 24. This is specifically engineered such that the degree of rotation causes the first member to rotate (clock) between a "free" position (FIG. 16) where the fins 64 align with the slots 59 on the second (immovable) member and a locked position (FIG. 15) where the fins 64 abut against the profile 60.

Figure 4:
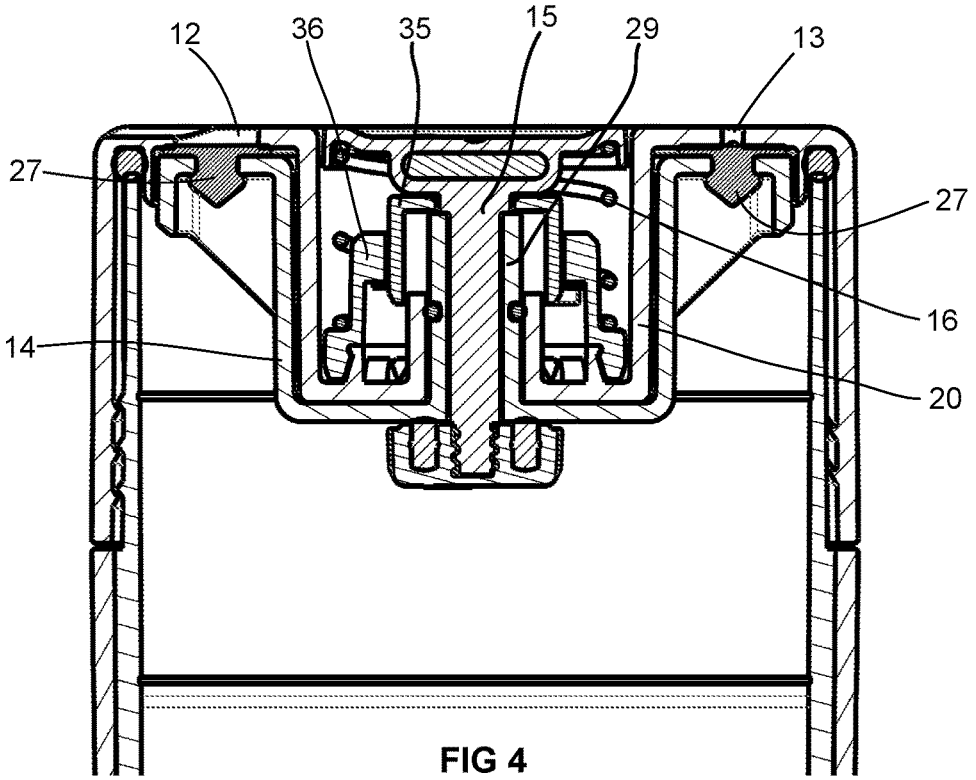
FIG. 4. Illustrates a section view of the lid assembly in the closed position.

This arrangement is repeated every time the actuator is pushed down. For instance, if the actuator is initially in the closed sealing position, this is the position where the inner member is in the free position and has moved at least partially past the outer member. In FIG. 4, this is illustrated by referring to the section view of inner member 35 which extends at least partially through the outer member 36 and which abuts against the underside of the actuator 15.

Figure 5:
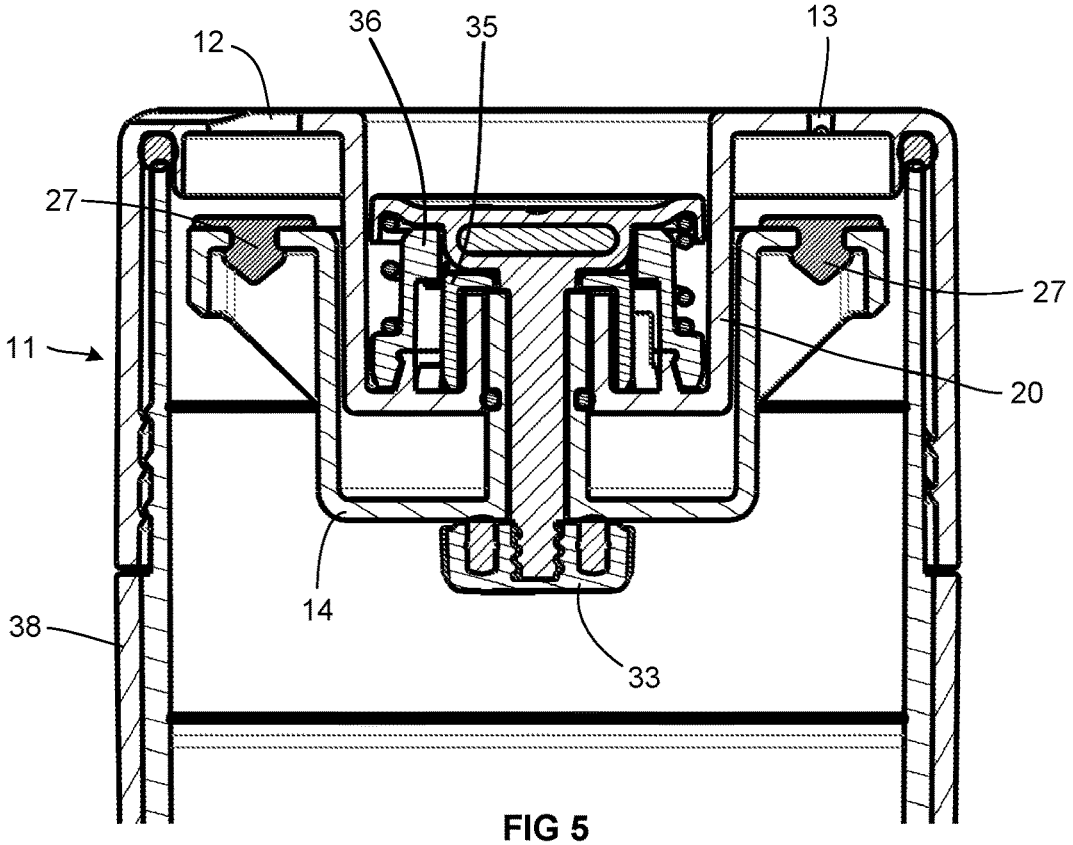
FIG. 5. Illustrates a section view of the lid assembly in the open position where beverage can be sipped from the container.

When the actuator is pressed, the underneath of the actuator head portion 31 will push against the first inner member 35 and will cause the first inner member to be pushed downwardly to be completely within the confines of the second outer member, this being the position illustrated in FIG. 5. During this process, the first inner member 35 will push against the top of the spigot 29 which forms part of the valve member 14 (it being recollected that the diameter of the spigot 29 is larger than the small opening 62 in the first inner member), and will cause the valve member to be pushed downwardly from the sealing position illustrated in FIG. 4 to the open position illustrated in FIG. 5. The spring 16 is also compressed during the process.

Importantly, as the inner member 35 is being pushed downwardly, the lower walls of the fins 64 will, at some stage, contact the guide portions 24 at the inner end of the passageway 20 and this will cause the inner member to be clocked or slightly rotated in one direction. This rotation now removes the alignment of the fins 64 with the slots 59 and instead now aligns fins 64 with the profiles 60 on the inside of second outer member 36.

Thus, when the actuator button 15 is released, the spring will push the button back towards extended position and as the pin portion 32 of the actuator is attached (via the locking nut 33) to the valve member 14, the valve member 14 will be pulled towards the sealing position. However, this is now prevented because as the valve member is being pulled upwardly, the spigot portion 29 on the valve member 14 abuts against the inside of the first inner member 35 and begins to push the inner member 35. Inner member 35 (after a short distance) abuts against the profile 60 of the outer member and cannot move any further. This whole arrangement prevents the actuator 15 (and therefore valve member 14) to move from the open position illustrated in FIG. 5 to the closed position illustrated in FIG. 4.

The lid assembly is now locked in the open position and the contents of the container can pass through the open outlet 12. Pressure equalising air can also pass into the container through the open area openings 13.

To reseal the lid assembly, all that is required is to again press the (already partially depressed—see FIG. 5) actuator a little bit further into the passageway. This causes the bottom of the head portion 31 of the actuator to press against and push down the locked first inner member 35 away from the profiles 60 and back into position where the bottom wall 65 of the fins 64 engage with the guide portions 24 in the passageway 20. As mentioned above, this engagement will cause the first inner member 35 to slightly rotate in one direction which now causes the fins 64 to become aligned with the slots 59. When the actuator is released, it can now move back to the fully closed position (FIG. 4) as the inner member can now move past the outer member because of the alignment of fins 64 with slots 59.

This arrangement is reliable method to allow the lid assembly to adopt an open and closed position merely by pressing the actuator. The actuator can be pressed by a person's finger and there is no cumbersome twisting action required to access the contents of the container.

The actuator is positioned quite separate from the outlet which means that operating the actuator provides minimal risk of hot contents of the container spilling onto a person's fingers during opening or closing potentially causing burns.

The lid assembly will typically be attached to a container 38. In a preferred embodiment, the lid assembly and the container can be purpose designed to complement each other. Thus, this can result in a slimline beverage container comprising the lid assembly. The container may be insulated or be provided with a tactile or grip enhancing surface. The container will typically be able to hold a volume of between 200-2 L of liquid although this can vary.

Use For The Invention

The above description identifies at least one specific, substantial and credible use for the invention. Specifically, the lid assembly can be attached to a container of liquid to provide a safe and reliable method to access the container contents and to provide a secure and spill proof seal merely by pressing the actuator button when the contents of the container are not required.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

Throughout the specification and claims (if present), unless the context requires otherwise, the term "substantially" or "about" will be understood to not be limited to the value for the range qualified by the terms.

The invention claimed is:

1. A container lid assembly with a press button opening, the lid assembly comprising:

a lid adapted for connection to a container, the lid having a first outlet opening and a second air opening wherein the first outlet opening and the second air opening are separate openings spaced from each other;

a valve member in the lid;

a press button actuator;

a biasing member;

wherein the lid has a top wall containing the first outlet opening, the top wall including a passageway, the press button actuator comprising a head portion located in the passageway and a pin portion, the pin portion enabling the valve member to be attached to the actuator, the press button actuator being positioned separate from the first outlet opening; and a lock assembly wherein the lock assembly comprises a first inner member and a second outer member, the inner member including an opening to enable the inner member to fit about the pin portion of the press button actuator and to be rotatable about the pin portion, the second outer member being fixed to the lid to prevent rotation of the outer member, the inner member being locked against the outer member at at least one rotative position to maintain the press button actuator in the open position, and being released from the outer member at another rotative position to enable movement of the press button actuator to the closed position, wherein the first inner member is positioned below the head portion of the press button actuator, depression of the press button actuator causing the inner member to rotate from one said rotative position to the other said rotative position, wherein the passageway comprises an inner wall, the wall formed with at least one locking fin adapted for engagement with the outer member to prevent the outer member from rotating, wherein the inner wall comprises a plurality of guide portions in the form of ramped teeth, the inner member adapted for movement between said rotative positions upon engagement with said guide portions, wherein:

the valve member is slidingly moveable between an open position where the outlet opening and the air opening are open and a closed position where the outlet opening and air opening are closed by the valve member, the valve member has a first sealing member adapted to seal the first outlet opening and a separate second sealing member adapted to seal the second air opening, the first sealing member comprising a first leg member and the second sealing member comprising a second leg member and the first leg member comprising a separately formed first leg seal member formed from separate material to the first leg member and the second leg member comprising a separately formed second leg seal member formed from separate material to the second leg member, the first leg member and the second leg member sized to fit between a respective pair of lugs on the lid so that the valve can slide up and down but the valve cannot turn clockwise or anticlockwise, the press button actuator is connected to the valve member and is moveable between a depressed open position where the actuator moves the valve member to its open position and an extended closed position where the actuator moves the valve member to its closed position, the biasing member biases the actuator to the extended closed position and the actuator is depressed against the bias of the biasing member, the lock assembly controlling movement of the actuator such that one press of the actuator causes the actuator to adopt one of the open or closed positions and a second press of the actuator causes the actuator to adopt the other of the open or closed positions, the lid having a top wall containing the first outlet opening, the top wall having an outer face and an inner face, a peripheral side wall, an inner side wall depending from the inner face of the top wall, the valve member adapted for sliding movement along the inner side wall between the open position and the closed position, and the lid having an anti-rotation assembly to prevent the valve member from rotating about the inner wall.

2. The assembly of claim 1, wherein the biasing member comprises a spring located at least partially about the pin portion of the actuator.

3. The assembly as claimed in claim 1, wherein the lid is engageable to an open topped container.

4. The assembly of claim 3, including a sealing member locatable between the lid assembly and the container to seal the lid assembly to the container.

5. The assembly of claim 1 wherein the valve member is formed with apertures therethrough to permit water flow for cleaning within the valve member.

6. A lid assembly according to claim 1 in combination with a container.

7. The assembly of claim 6, wherein the container is a beverage container.

* * * * *